US010394162B2

(12) United States Patent
Mukai et al.

(10) Patent No.: US 10,394,162 B2
(45) Date of Patent: Aug. 27, 2019

(54) DEVELOPING APPARATUS, PROCESS CARTRIDGE, AND IMAGE FORMING APPARATUS

(71) Applicant: CANON KABUSHIKI KAISHA, Tokyo (JP)

(72) Inventors: Takashi Mukai, Kawasaki (JP); Kazunari Hagiwara, Yokohama (JP); Koji An, Tokyo (JP); Takaaki Shinkawa, Tokyo (JP); Takuya Kitamura, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/152,486

(22) Filed: Oct. 5, 2018

(65) Prior Publication Data

US 2019/0113861 A1 Apr. 18, 2019

(30) Foreign Application Priority Data

Oct. 13, 2017 (JP) ..... 2017-199261

(51) Int. Cl.
*G03G 15/08* (2006.01)
*G03G 21/18* (2006.01)

(52) U.S. Cl.
CPC ..... *G03G 15/0812* (2013.01); *G03G 21/1814* (2013.01)

(58) Field of Classification Search
CPC ..... G03G 15/0812; G03G 21/1814
See application file for complete search history.

(56) References Cited

U.S. PATENT DOCUMENTS

| | | | | |
|---|---|---|---|---|
| 5,933,692 | A * | 8/1999 | Niwano | G03G 15/0812 399/284 |
| 7,251,441 | B2 | 7/2007 | Hagiwara et al. | |
| 7,379,693 | B2 | 5/2008 | Ogawa et al. | |
| 7,773,923 | B2 | 8/2010 | Hagiwara et al. | |
| 8,577,249 | B2 | 11/2013 | Adachi et al. | |
| 9,002,225 | B2 | 4/2015 | Oshima et al. | |
| 9,134,649 | B2 | 9/2015 | Orihara et al. | |
| 9,170,525 | B2 | 10/2015 | Adachi et al. | |
| 9,298,128 | B2 | 3/2016 | Orihara et al. | |
| 9,442,418 | B2 | 9/2016 | Kawamoto et al. | |

(Continued)

FOREIGN PATENT DOCUMENTS

| | | | |
|---|---|---|---|
| JP | H06-289703 | A | 10/1994 |
| JP | 11194609 | A * | 7/1999 |
| JP | 2003-307991 | A | 10/2003 |

OTHER PUBLICATIONS

Kazunari Hagiwara et al., U.S. Appl. No. 16/155,940, filed Oct. 10, 2018.

*Primary Examiner* — Susan S Lee
(74) *Attorney, Agent, or Firm* — Venable LLP

(57) ABSTRACT

A relation between a first thickness of a resin layer in an upstream portion of a contact nip in which the resin layer that covers a supporting member of a regulating blade makes contact with a developing roller and a second thickness of the resin layer in a downstream portion of the contact nip is set such that the second thickness is smaller than the first thickness. A potential difference having the same polarity as a toner charging polarity toward the supporting member is created between the supporting member and the developing roller.

14 Claims, 11 Drawing Sheets

(56) References Cited

U.S. PATENT DOCUMENTS

| | | | | |
|---|---|---|---|---|
| 10,078,291 | B2 | 9/2018 | Shinkawa et al. | |
| 2006/0078358 | A1* | 4/2006 | Yasui | G03G 15/0812 399/284 |
| 2008/0095555 | A1* | 4/2008 | Saeki | G03G 15/0812 399/284 |
| 2008/0247791 | A1* | 10/2008 | Iwata | G03G 15/0812 399/350 |
| 2008/0310886 | A1 | 12/2008 | Shimizu et al. | |
| 2012/0045255 | A1* | 2/2012 | Hamada | G03G 15/0812 399/284 |
| 2012/0301189 | A1* | 11/2012 | Kase | G03G 15/0812 399/284 |
| 2014/0334854 | A1 | 11/2014 | Kitamura et al. | |
| 2018/0031998 | A1* | 2/2018 | Okuda | G03G 15/0812 |

* cited by examiner

DEVELOPING APPARATUS, PROCESS CARTRIDGE, AND IMAGE FORMING APPARATUS

BACKGROUND OF THE INVENTION

Field of the Invention

The present invention relates to an electrophotographic image forming apparatus that forms an image on a recording medium.

Description of the Related Art

As a developing apparatus incorporated in an electrophotographic image forming apparatus such as a printer and a facsimile, a configuration including a developer carrying member that develops an electrostatic latent image formed on a surface of an image bearing member using a developer and a regulating member that regulates the amount of a developer layer on the surface of the developer carrying member is known. In order to obtain a stable image output in such a developing apparatus, the regulating member needs to charge a developer while forming a developer layer uniformly on the developer carrying member to obtain a uniform layer thickness and a stable charge quantity. To achieve this, in general, as disclosed in Japanese Patent Application Publication No. 6-289703, a developing bias voltage is applied to a developer carrying member to perform developing and a regulating bias voltage is applied to a regulating member to charge a developer appropriately. However, due to long-term use or the like, the developer may be stuck and fused to the regulating member. In this case, the flow of the developer may be blocked, a stable layer thickness may not be formed, and a low density portion or vertical streaks may appear in an image.

In order to solve such a problem, Japanese Patent Application Publication No. 2003-307991 discloses a configuration in which a potential difference (hereinafter a blade bias) having the same polarity as a charging polarity of a developer toward a regulating member is created between a developer carrying member and the regulating member during a developing operation. By forming such a potential difference, the developer is charged appropriately, sticking and fusing of the developer to the regulating member can be prevented, and a low density portion or vertical streaks appearing on an image can be prevented. In recent years, it is necessary to reduce fogging due to a low charge quantity of a developer in order to reduce size and cost. Specifically, this is because the size of a cleaning device can be decreasing by decreasing the amount of developer collected to the cleaning device and the amount of developer usable for image formation can be increased without changing the amount of developer filled into a developing apparatus.

Here, the fogging can be suppressed by increasing the charge quantity of developer. This is because an electrical force for allowing a developing portion to move a developer in a regular direction based on an electric field formed by the potential difference between the image bearing member and the developer carrying member can be increased. As one means, the blade bias may be increased similarly to the above-described conventional example. As another means, a distance that the developer rubs for charging may be increased and a charge quantity may be increased. That is, a configuration in which a nip width that the regulating member makes contact with the developer carrying member is increased to suppress fogging may be considered.

SUMMARY OF THE INVENTION

However, in the above-described conventional example, if the blade bias is increased too much, it may be difficult to regulate the amount of a developer layer appropriately. This is because, when an electrical force pressing a developer toward the developer regulating blade is increased, a larger amount of developer enters into the lower side of the regulating member. When regulation defects occur, since a large amount of developer more than necessary is used for developing, image defects such as density unevenness in a printing portion or background fogging in a non-printing portion may occur. In addition to this, if the blade bias is increased too much, image defects resulting from leakage or deterioration of electrification in a resin layer of the regulating member or the developer carrying member may occur.

On the other hand, increasing the nip width of a contact portion of the regulating member may lead to an increase in the charge quantity while realizing appropriate regulation. Moreover, when the width of a contact nip is increased while increasing the blade bias within a range where the regulation defects do not occur, since a larger developer charge quantity is obtained, it is possible to suppress fogging more satisfactorily. However, in a configuration in which such a contact nip width is increased, since the attachment force of a developer to the regulating member on the downstream side of the contact nip where the charge quantity is increased increases, the developer may be easily stuck and fused to the regulating member. Even when such a blade bias as the above-described conventional example is formed, sticking and fusing of the developer to the regulating member may occur in a configuration where the contact nip width is increased. Particularly, when the blade bias is small, the fixing and fusing become more remarkable. From the above, in the configuration in which the nip width of the contact portion of the regulating member is increased, it is difficult to prevent both the developer regulation defects and the fixing and fusing of the developer to the regulating member.

An object of the present invention is to prevent the occurrence of image defects such as a low density portion or vertical streaks resulting from the sticking and fusing of a developer to a regulating member without causing image defects such as density unevenness or background fogging resulting from developer regulation defects while increasing a developer charge quantity to suppress fogging.

In order to achieve the object described above, a developing apparatus according to an embodiment of the present invention includes:

- a developer carrying member that carries a developer;
- a development frame member that rotatably supports the developer carrying member and stores the developer; and
- a regulating member provided in the development frame member to regulate a thickness of the developer carried on the developer carrying member, wherein
- the regulating member includes a supporting member having a conductive property, and a contact member having a larger resistivity than that of the supporting member,
- in a cross-section orthogonal to a rotation axis direction of the developer carrying member,
- the contact member has a contact portion that contacts with a surface of the developer carrying member, and the supporting member is disposed to be present on a normal line of the developer carrying member passing through the contact portion, and the contact portion has a first region and a second region positioned on a downstream side of the first region in a rotation direction of the developer carrying member, wherein when a thickness of the contact member, between the first region and the supporting member, in a first direction along a first normal line passing through the first region, is a first thickness, and a thickness of the contact member, between the second region and the supporting member, in a second direction along a second normal line passing through the second region, is a second thickness, the first thickness is larger than the second thickness, wherein when a third normal line of the developer carrying member, passing through a position at which a distance between a rotation center of the developer carrying member and the supporting member is the shortest, is used as a reference, the contact portion is disposed at a position which is not on the downstream side of the third normal line but on the upstream side of the developer carrying member, in the rotation direction of the developer carrying member, and wherein when a potential of the supporting member is V1 and a potential of the developer carrying member is V2 during a developing operation, a polarity of a potential difference (V1−V2) between the supporting member and the developer carrying member is the same as a charging polarity of the developer.

In order to achieve the object described above, a developing apparatus according to the embodiment of the present invention includes:

a developer carrying member that carries a developer;

a development frame member that rotatably supports the developer carrying member and stores the developer; and a regulating member provided in the development frame member to regulate a thickness of the developer carried on the developer carrying member, wherein the regulating member includes:

a first contact portion that contacts with the developer carrying member, a first conductive portion that has a smaller resistivity than that of the first contact portion, and that faces a surface of the developer carrying member at a first distance with the first contact portion disposed therebetween, a second contact portion that contacts with the developer carrying member on a downstream side of the first contact portion in a rotation direction of the developer carrying member, and a second conductive portion that has a smaller resistivity than that of the second contact portion, and facing the surface of the developer carrying member on the downstream side of the first conductive portion in the rotation direction of the developer carrying member, at a second distance shorter than the first distance with the second contact portion disposed therebetween, and wherein, potentials of the first and second conductive portions are configured to be larger than a potential of the developer carrying member and be the same polarity as a charging polarity of the developer, during a developing operation.

In order to achieve the object described above, a developing apparatus according to the embodiment of the present invention includes:

a developer carrying member that carries a developer;

a development frame member that rotatably supports the developer carrying member and stores the developer; and a regulating member provided in the development frame member to regulate a thickness of the developer carried on the developer carrying member, wherein the regulating member includes a supporting member having a conductive property, and a contact member having a larger resistivity than that of the supporting member, in a cross-section orthogonal to a rotation axis direction of the developer carrying member, the contact member has a contact portion that contacts with a surface of the developer carrying member, and the supporting member is disposed to be present on a normal line of the developer carrying member passing through the contact portion, and the contact portion has a first region and a second region positioned on a downstream side of the first region in a rotation direction of the developer carrying member, wherein when a thickness of the contact member, between the first region and the supporting member, in a first direction along a first normal line passing through the first region, is a first thickness, and a thickness of the contact member, between the second region and the supporting member, in a second direction along a second normal line passing through the second region, is a second thickness, the first thickness is larger than the second thickness, wherein when a third normal line of the developer carrying member, passing through a position at which a distance between a rotation center of the developer carrying member and the supporting member is the shortest, is used as a reference, the contact portion is disposed at a position which is not on the downstream side of the third normal line but on the upstream side of the developer carrying member, in the rotation direction of the developer carrying member, and wherein, a potential difference having the same polarity as a charging polarity of the developer toward the supporting member, is formed between the supporting member and the developer carrying member, during a developing operation.

In order to achieve the object described above, a process cartridge detachably attached to an apparatus body of an image forming apparatus according to the embodiment of the present invention includes:

an image bearing member on which an electrostatic latent image is formed; and the developing apparatus for developing the electrostatic latent image.

In order to achieve the object described above, an image forming apparatus includes:

the developing apparatus;

an apparatus body to which the developing apparatus is detachably attached; and a bias application portion that applies biases having different magnitudes to the developer carrying member and the regulating member.

According to the present invention, it is possible to prevent the occurrence of image defects such as a low density portion or vertical streaks resulting from the sticking and fusing of a developer to a regulating member without causing image defects such as density unevenness or background fogging resulting from developer regulation defects while increasing a developer charge quantity to suppress fogging.

Further features of the present invention will become apparent from the following description of exemplary embodiments with reference to the attached drawings.

DESCRIPTION OF THE EMBODIMENTS

Hereinafter, exemplary embodiments for carrying out the present invention will be described in detail with reference to the drawings. Dimensions, materials, shapes, and relative arrangements of the components described in the embodiments may be changed appropriately depending on a configuration of an apparatus to which the present invention is applied and various conditions. That is, the scope of the present invention is not limited to the following embodiments.

Embodiment 1

Overall Schematic Configuration of Image Forming Apparatus

Figure 2:
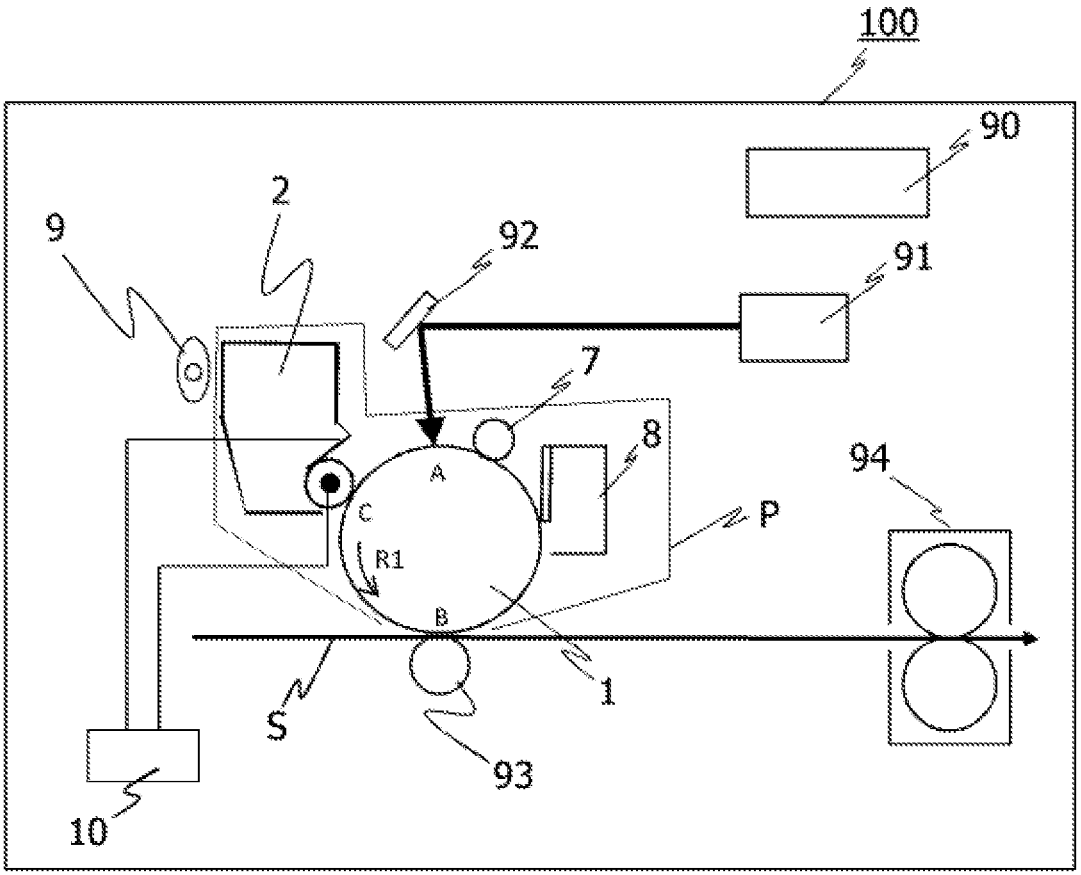
FIG. 2 is a schematic diagram of an image forming apparatus according to an embodiment of the present invention.

An overall configuration of an electrophotographic image forming apparatus (hereinafter an image forming apparatus) according to an embodiment of the present invention will be described with reference to FIG. 2. FIG. 2 is a schematic cross-sectional view illustrating an overall configuration of an image forming apparatus 100 according to an embodiment of the present invention.

Here, an image forming apparatus is an apparatus that forms an image on a recording material (a recording medium) using a developer (toner) according to an electrophotographic image forming process. Examples of the image forming apparatus include an electrophotographic copier, an electrophotographic printer (for example, an LED printer, a laser beam printer, and the like), an electrophotographic facsimile apparatus, an electrophotographic word processor, and a complex machine (a multifunction printer) thereof. Moreover, a recording material is a recording medium on which an image is formed, and examples thereof include a recording paper, an OHP sheet, a plastic sheet, and a fabric.

The image forming apparatus 100 includes, as its main components, a photosensitive drum 1 as an image bearing member, a developing apparatus 2, a cleaning device 8, a charging roller 7, an exposure device 91, a transfer roller 93, and a fixing device 94. The photosensitive drum 1, the developing apparatus 2, the cleaning device 8, and the charging roller 7 are integrated as a process cartridge P, and are detachably attached to an image forming apparatus body (a portion of the image forming apparatus 100 excluding the process cartridge P). As a process cartridge, another configuration in which an electrophotographic photosensitive drum is integrated with at least one of a charging device, a developing means, and a cleaning means as a process means to be used in this electrophotographic photosensitive drum as a cartridge may be also used appropriately. Moreover, the developing apparatus 2 may be solely detachably attached to the apparatus body or the process cartridge P.

The photosensitive drum 1 is a drum-shaped photosensitive member having an outer diameter of 20 mm, and the developing apparatus 2 is arranged to face the photosensitive drum 1. The developing apparatus 2 contains toner having a negative regular charging polarity (a charging polarity for developing an electrostatic latent image). The exposure device 91 and a reflection mirror 92 are disposed so that a laser beam emitted from the exposure device 91 arrives at an exposure position A on the photosensitive drum 1 via the reflection mirror 92. The transfer roller 93 is disposed under the photosensitive drum 1. The cleaning device 8 is provided on the downstream side in the moving direction (a rotation direction R1) of the photosensitive drum in relation to a transfer position B. The cleaning device 8 is disposed in contact with the photosensitive drum 1 so that a blade included in the cleaning device 8 scrapes off the toner on the photosensitive drum 1.

An image forming operation of the image forming apparatus 100 will be described. A controller portion 90 controls the following image forming operation according to a predetermined control program and a reference table in an integrated manner. First, the surface of the photosensitive drum 1 rotating at a speed of 100 mm/sec in the direction indicated by arrow R1 is charged to a predetermined potential by the charging roller 7. At the exposure position A, an electrostatic latent image is formed on the photosensitive drum 1 using a laser beam emitted from the exposure device 91 according to an image signal. The formed electrostatic latent image is developed by the developing apparatus 2 at a developing position C to form a toner image. The toner image formed on the photosensitive drum 1 is transferred to a transfer material S at the transfer position B. The transfer material S as a recording medium to which the toner image is transferred is delivered to the fixing device 94. The fixing device 94 pressurizes and heats the toner image on the transfer material S to fix the transfer material S to obtain a final image.

Overall Schematic Configuration of Developing Apparatus

Figure 1:
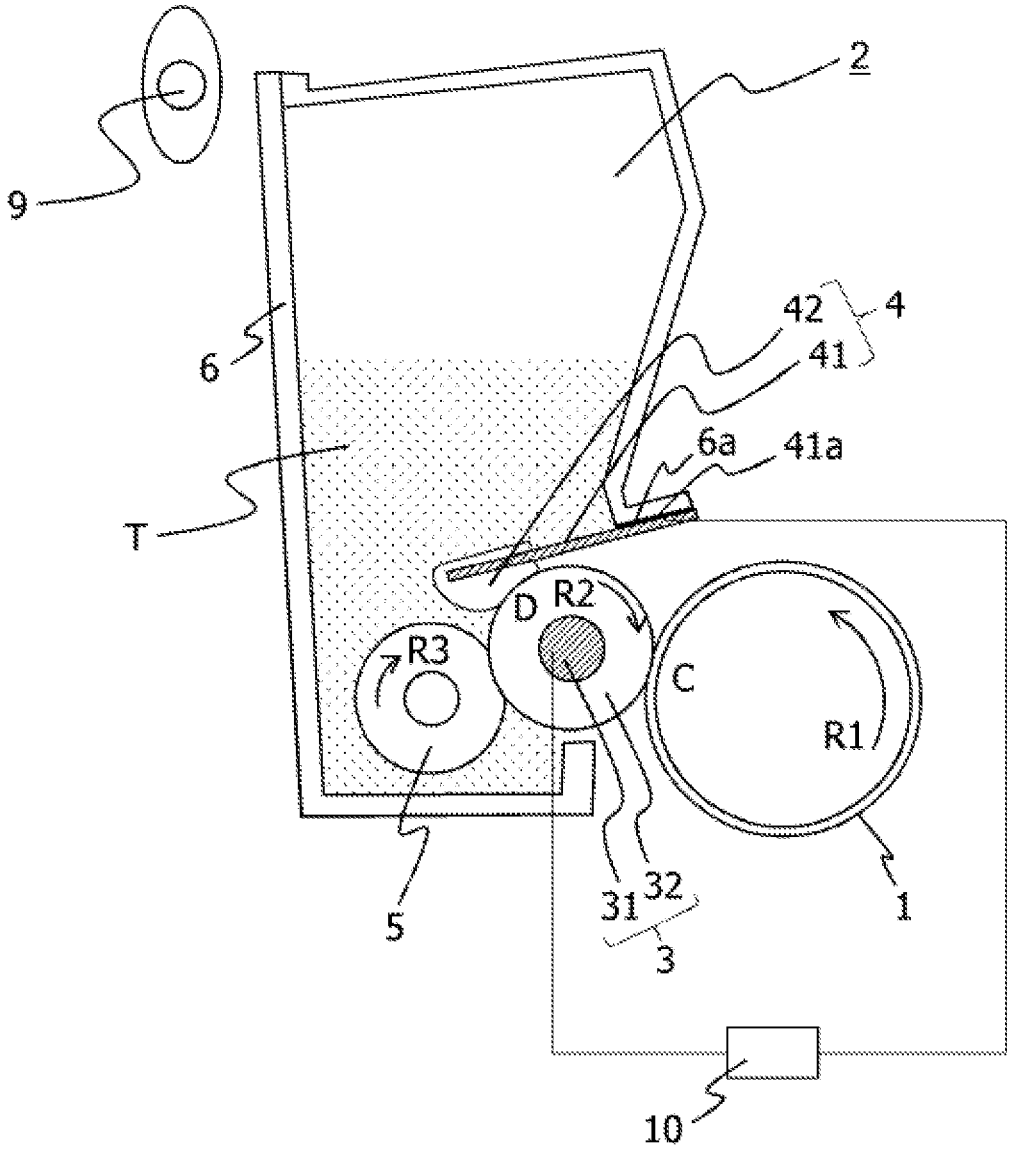
FIG. 1 is a schematic diagram of a developing apparatus according to an embodiment of the present invention.

An overall configuration of the developing apparatus 2 according to an embodiment of the present invention will be described with reference to FIG. 1. FIG. 1 is a schematic cross-sectional view illustrating a schematic configuration of the developing apparatus 2 according to the present embodiment and is a diagram seen from the direction orthogonal to a rotation direction R2 of the developing roller 3 (seen from the direction of a rotation axis of the developing roller 3). As illustrated in FIG. 1, the developing apparatus 2 of the present embodiment includes the developer container 6, the developing roller 3, the regulating blade 4, and the supply roller 5.

The developer container 6 as a development frame member stores toner T which is a non-magnetic one-component developer. The developing roller 3 as a developer carrying member is disposed to make contact with the surface of the photosensitive drum 1 at a developing position C. The developing roller 3 is a rubber roller having an outer diameter of 10 mm obtained by forming an elastic layer 32 on an outer circumference of a conductive mandrel 31 and carries the toner T on the surface thereof. Moreover, the developing roller 3 is rotatably supported on the developer container 6 with the mandrel 31 disposed therebetween and is rotated in the direction indicated by arrow R2 at a speed of 180 mm/sec. When a predetermined bias is applied to the developing roller 3, the toner T is transferred to the electrostatic latent image formed on the photosensitive drum 1 whereby a visible image is formed. In order to avoid unnecessary contact between the photosensitive drum 1 and the developing roller 3 during a non-image forming operation, the contact and separation between the photosensitive drum 1 and the developing roller 3 is controlled when a cam 9 provided outside the developing apparatus 2 moves the developer container 6.

The regulating blade 4 as a regulating member that regulates the layer thickness of the toner T carried on the developing roller 3 has a layer structure including a conductive supporting member 41 and a resin layer 42 as a contact member, formed of a material having a higher resistivity than the supporting member 41 so as to cover the supporting member 41. In the present embodiment, the supporting member 41 is formed of a material having a resistivity of approximately $1\times10^{-8}$ Ω·m, and the resin layer 42 is formed of a material having a resistivity of approximately $1\times10^{5}$ to $1\times10^{7}$ Ω·m. The resin layer 42 protrudes toward the developing roller 3 and makes pressure-contact with the developing roller 3 at a contact nip D which is a contact surface extending along the surface of the developing roller 3. More specifically, an attachment position of the resin layer 42 of the regulating blade 4 is set to a place where the resin layer 42 enters into the developing roller 3. The resin layer 42 is deformed when making contact with the developing roller 3 and a repulsive force thereof generates a pressing force.

A blade bias application means 10 outside the developing apparatus 2 is electrically connected between the supporting member 41 of the regulating blade 4 and the mandrel 31 of the developing roller 3. The blade bias application means 10 includes a power supply circuit and the like and is configured to be able to apply bias voltages of different magnitudes individually to the developing roller 3 and the regulating blade 4. During a developing operation, the blade bias application means 10, applies a developing bias voltage Vdev to the developing roller 3 and applies a regulating bias voltage Vbld to the regulating blade 4.

Here, the voltages applied to respective members during an image forming operation (a developing operation) will be described. In the present embodiment, a voltage of −1050 V is applied to the charging roller 7 so that the surface potential of the photosensitive drum 1 is charged uniformly to −500 V. A printing portion is adjusted by the exposure device 91 so that the surface potential of the photosensitive drum 1 is −100 V. A developing bias voltage Vdev of −300 V is applied to the developing roller 3 whereby reversal development of transferring a negative-polarity toner T to the printing portion is performed. The regulating bias voltage Vbld applied to the regulating blade 4 is set to a negative polarity, which is the same polarity as the charging polarity of the toner T, as compared to the developing bias voltage Vdev.

In this manner, a blade bias Δ(=Vbld−Vdev) which is a potential difference of the regulating bias voltage Vbld with respect to the developing bias voltage Vdev is formed on the same polarity side as the charging polarity of the toner T. That is, a potential difference (V1−V2) is formed such that the potential V1 (voltage Vbld) of the regulating blade 4 (the supporting member 41) increases toward the same polarity side as the charging polarity of the toner T with respect to the potential V2 (voltage Vdev) of the developing roller 3 (the polarity of the potential difference (V1−V2) is the same as the charging polarity of the toner T). In this way, sticking and fusing of the toner T to the regulating blade 4 at the contact nip D can be prevented. As a result, the occurrence of a low density portion and vertical streaks can be prevented.

Here, the reason why sticking and fusing of the toner T can be prevented will be described. The toner T is fused to the regulating blade 4 because the toner T melts down when making contact with and being rubbed against the regulating blade 4 while receiving pressure. Due to this, the blade bias Δ is formed on the same polarity side as the charging polarity of the toner T toward the supporting member so that an electrical urging force toward the developing roller 3 is applied to the toner in the contact nip D. In this way, since the chance of the toner T to make contact with the regulating blade 4 decreases, fixing and fusing of the toner T can be prevented.

In the present embodiment, in order to obtain the effect of preventing fusing of the regulating blade based on the blade bias Δ on the entire surface of the contact nip D, the supporting member 41 is present on a normal line with respect to the surface of the developing roller 3 on the entire surface of the contact nip D with the resin layer 42 disposed therebetween. Due to the above-described configuration, the regulating blade 4 has a function of regulating the layer thickness of the toner T on the developing roller 3 and has a function of a developer charging means for applying predetermined charge to the toner T on the developing roller 3.

In the present embodiment, a flat plate-shaped stainless steel which is a metallic thin plate is used for the supporting member 41 so that the supporting member 41 has an elastic property (a spring property). In addition to stainless steel, phosphor bronze, an aluminum alloy, and the like may be used, and the supporting member 41 may be formed of a high-hardness resin. Even when a conductive resin is used for the supporting member 41, the resistivity thereof is generally approximately $1\times10^{0}$ to $1\times10^{2}$ Ω·m so that a sufficiently large resistivity of the resin layer 42 with respect to the supporting member 41 can be secured. The supporting member 41 has a fixed portion 41 on a base end side (one end side) thereof, and the fixed portion **41*a* is fixed to a fixing portion 6*a* formed on the developer container 6. In the present embodiment, a distal end side (the other end side) which is a free end of the supporting member 41 faces the upstream side in the rotation direction R2 of the developing roller 3. That is, the regulating blade 4 has a cantilever structure extending in the opposite direction with respect to the rotation direction R2 of the developing roller 3**.

In the present embodiment, the resin layer 42 is formed by coating the supporting member 41 with polyurethane. In addition to the above, the material of the resin layer 42 include polyamide, polyamide elastomer, polyester, polyester elastomer, polyester terephthalate, urethane rubber, urethane resin, silicone rubber, silicone resin, and melamine resin, which may be used individually or in combination of two or more. Besides this coating method, a method of forming the resin layer 42 is roughly classified into a method of forming the resin layer 42 directly on the supporting member 41 and a method of forming the resin layer 42 in advance and attaching the resin layer 42 to the supporting member 41. Examples of the method of forming the resin layer 42 directly on the supporting member 41 include a method of extruding a raw material to the supporting member 41 to form the resin layer 42 and a method of applying a raw material to a metallic thin plate by dipping, coating, spraying, or the like. Moreover, examples of forming the resin layer 42 in advance include a method of cutting a sheet created from a raw material and a method of forming the resin layer 42 using a metal mold or the like.

The supply roller 5 as a developer supply member is an elastic sponge roller obtained by forming a foam on an outer circumference of a conductive core. The supply roller 5 is arranged to make contact with the developing roller 3 with a predetermined penetration amount and forms a predetermined nip on a circumferential surface of the developing roller 3. The supply roller 5 rotates in the direction indicated by arrow R3 opposite to the rotation direction R2 of the developing roller 3 at the nip between the developing roller 3 and the supply roller 5 to supply toner T to the developing roller 3.

The developing roller 3 and the supply roller 5 are disposed under a toner T storage space (a storage chamber) of the developer container 6. A vertical direction in FIGS. 1 and 2 corresponds to a vertical direction in a normal installation state of an image forming apparatus. The rotation center of the supply roller 5 is positioned below the rotation center of the developing roller 3. The regulating blade 4 is provided so that one end side supported on the developer container 6 is positioned above the other end side of a free end. The position of a contact nip D between the regulating blade 4 and the developing roller 3 is positioned above the rotation center of the developing roller 3, and the toner T carried on the developing roller 3 enters into the contact nip D from a lower side toward an upper side. The gap between the lower end of the developing roller 3 and the developer container 6 is sealed by a flexible sheet member (not illustrated) so as to prevent leakage of the toner T. The arrangement of respective members is not limited thereto, and the present invention can be applied to a developing apparatus having another configuration in which the regulating blade 4 is positioned under the developing roller 3, and the toner T enters into the contact nip D from the upper side toward the lower side, for example.

Detailed Configuration of Developing Apparatus

The shape and the contact state of the regulating blade 4 which is a feature of the present embodiment will be described with reference to FIG. 1 and FIGS. 3 to 7.

Figure 3:
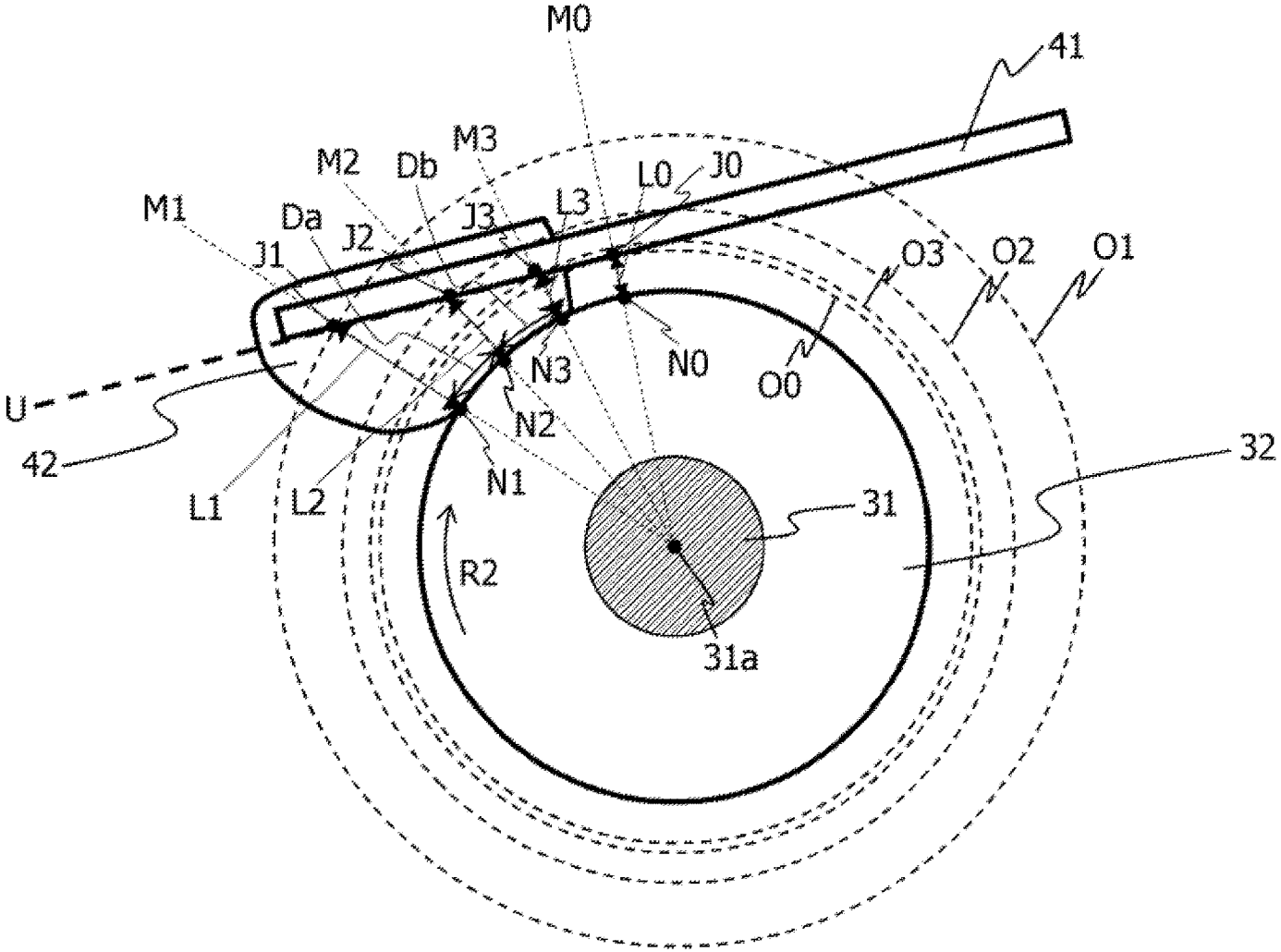
FIG. 3 is a schematic cross-sectional view of a developing roller and a regulating blade according to Embodiment 1.

FIG. 3 is a schematic cross-sectional view illustrating a state in which the regulating blade 4 makes contact with the developing roller 3 according to Embodiment 1 and is a diagram seen from a direction orthogonal to the rotation direction R2 of the developing roller 3 (seen from the direction of the rotation axis of the developing roller 3). As illustrated in FIGS. 1 and 3, in the regulating blade 4, a continuous curve shape is formed on a surface facing the developing roller 3, of the resin layer 42 provided on the distal end side which is the free end of the supporting member 41 as a contact portion. The resin layer 42 of the regulating blade 4 makes contact with the developing roller 3 to form a contact nip D which is a continuous contact surface. Here, a relation between a contact nip width and a toner charge quantity will be described with reference to FIG. 4.

Figure 4:
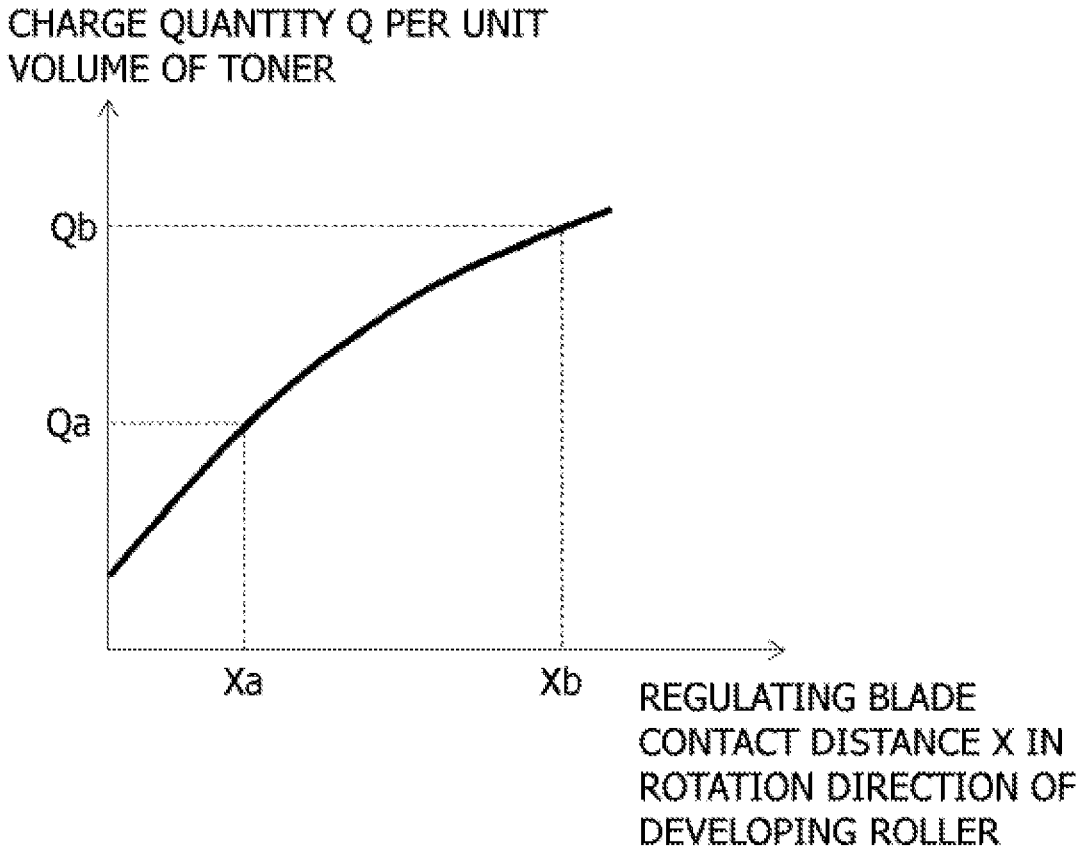
FIG. 4 is a diagram illustrating a relation between a nip width and a toner charge quantity.

FIG. 4 is a diagram illustrating a relation between a contact nip width and a toner charge quantity. The toner T is charged by being rubbed in the contact nip D between the regulating blade 4 and the developing roller 3. Due to this, as illustrated in FIG. 4, the larger the contact distance X between the regulating blade 4 and the developing roller 3, the larger the charge quantity Q per unit volume of the toner T. Therefore, as in the present embodiment, by increasing the length of the contact nip D against which the toner is rubbed for charging, the toner charge quantity can be increased. Since a large toner charge quantity can be maintained, it is possible to reduce fogging. In order to obtain the advantage of the present invention, the contact nip D does not need to be a continuous single surface, and the contact nip may be divided into a plurality of contact nips as long as a sufficient length of the contact nip is secured so that a toner charging property is increased.

As illustrated in FIG. 3, in a direction normal to the surface of the developing roller 3, the position at which the developing roller 3 approaches closest to the supporting member 41 is a point J0 on the supporting member 41 and a point N0 on the developing roller 3. A straight line passing through the points J0 and N0 is referred to as a straight line M0. Moreover, the distance between the points J0 and N0 is referred to as a distance L0. The contact nip D is formed on the upstream side in the rotation direction of the developing roller 3 with respect to the straight line M0. By allowing the regulating blade 4 to make contact with the developing roller 3 on the upstream side in the rotation direction of the straight line M0, a state in which a thickness Lb on the downstream side in the rotation direction is smaller than a thickness La on the upstream side in the rotation direction to be described later can be realized in a wide region of the contact nip D. In the present embodiment, since the developing roller 3 is a cylindrical rotating member, the normal line to the surface of the developing roller 3 is a straight line passing through the rotation center (central point) 31*a* of the developing roller 3. Moreover, the distance between the rotation center 31*a* of the developing roller 3 and a straight line U passing through the points J1 and J3 on the supporting member 41 to be described later is the shortest on the straight line M0.

Next, in order to describe the shape of the regulating blade 4, the points N1, N2, and N3 in the contact nip D arranged in that order from the upstream side in the rotation direction (arrow R2) of the developing roller 3 will be discussed. The normal lines to the surface of the developing roller 3 for the respective points N1, N2, and N3 are defined as straight lines M1, M2, and M3, respectively. The respective straight lines cross the points J1, J2, and J3 on the supporting member 41. Here, a segment between the points N1 and N2 is defined as a contact nip upstream Da, and a segment between the points N2 and N3 is defined as a contact nip downstream Db. In this example, for the sake of description, the contact nip upstream Da and the contact nip downstream Db have the same length. Moreover, a thickness La of the resin layer 42 in the contact nip upstream Da and a thickness Lb of the resin layer 42 in the contact nip downstream Db in the direction normal to the surface of the developing roller 3 will be considered. The thickness La of a first region of the contact portion or the thickness La on the upstream side of the resin layer 42 as a first contact portion is the thickness between the distance L1 between the points J1 and N1 and the distance L2 between the points J2 and N2. That is, a portion (the first conductive portion) between the points J1 and J2 of the conductive supporting member 41 faces the surface of the developing roller 3 (at the first distance La) with the region of the thickness La on the upstream side of the resin layer 42 disposed therebetween. Moreover, the thickness Lb of a second region of the contact portion or the thickness Lb on the downstream side of the resin layer 42 as a second contact portion is the thickness between the distance L2 between the points J2 and N2 and the distance L3 between the points J3 and N3. That is, a portion (the second conductive portion) between the points J2 and J3 of the conductive supporting member 41 faces the surface of the developing roller 3 (at the distance Lb) with the region of the thickness Lb on the downstream side of the resin layer 42 disposed therebetween. Here, circles O0, O1, O2, and O3 which are circles of which the radii from the rotation center 31*a* of the developing roller 3 are distances L0, L1, L2, and L3 are illustrated in FIG. 3 so that the relation between the distances L0 to L3 is understood. As illustrated in FIG. 3, the distances L1, L2, and L3 decrease in that order. Therefore, in the present embodiment, the thickness Lb on the downstream side is smaller than the thickness La on the upstream side.

A force that toner receives in the contact nip D will be described with reference to FIG. 5. The force that toner receives is roughly classified into an attachment force F1 for attaching toner to a member, associated with a toner charge quantity and an urging force F2 associated with an electric field occurring due to forming of the blade bias Δ. Specifically, the toner present near the surface of the regulating blade 4 inside the contact nip D receives the attachment force F1 toward the regulating blade 4 and the urging force F2 toward the developing roller 3. Moreover, the toner present near the surface of the developing roller 3 receives the attachment force F1 toward the developing roller 3 and the urging force F2 toward the developing roller. Here, the attachment force F1 is mainly an electrical image force and is approximately inverse-proportional to the square of the distance to a member. Due to this, the direction in which the attachment force acts is inverted depending on a member near which toner is present.

Figure 5:
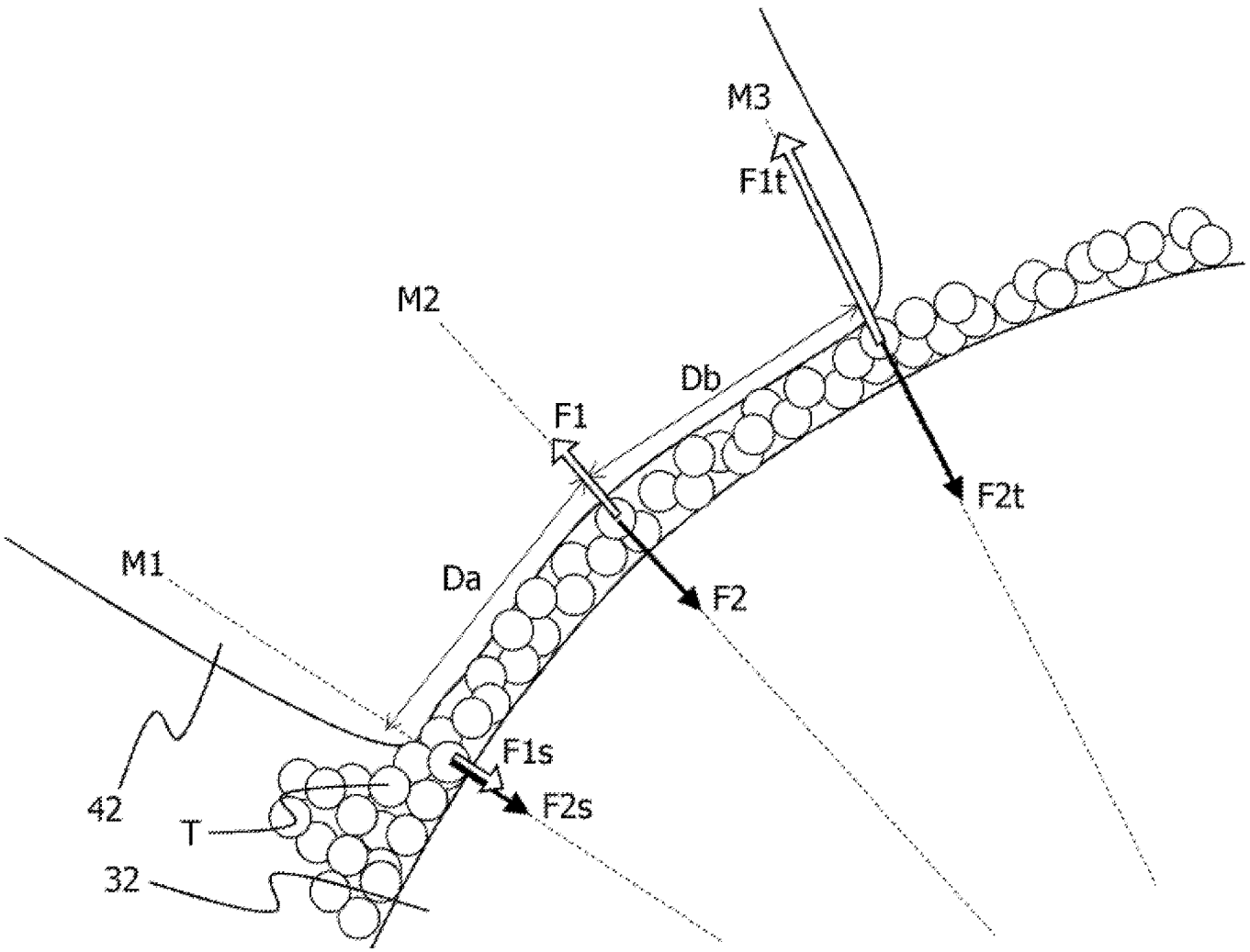
FIG. 5 is a schematic diagram illustrating attachment force F1 and urging force F2 acting on toner according to Embodiment 1.
Figure 6A:
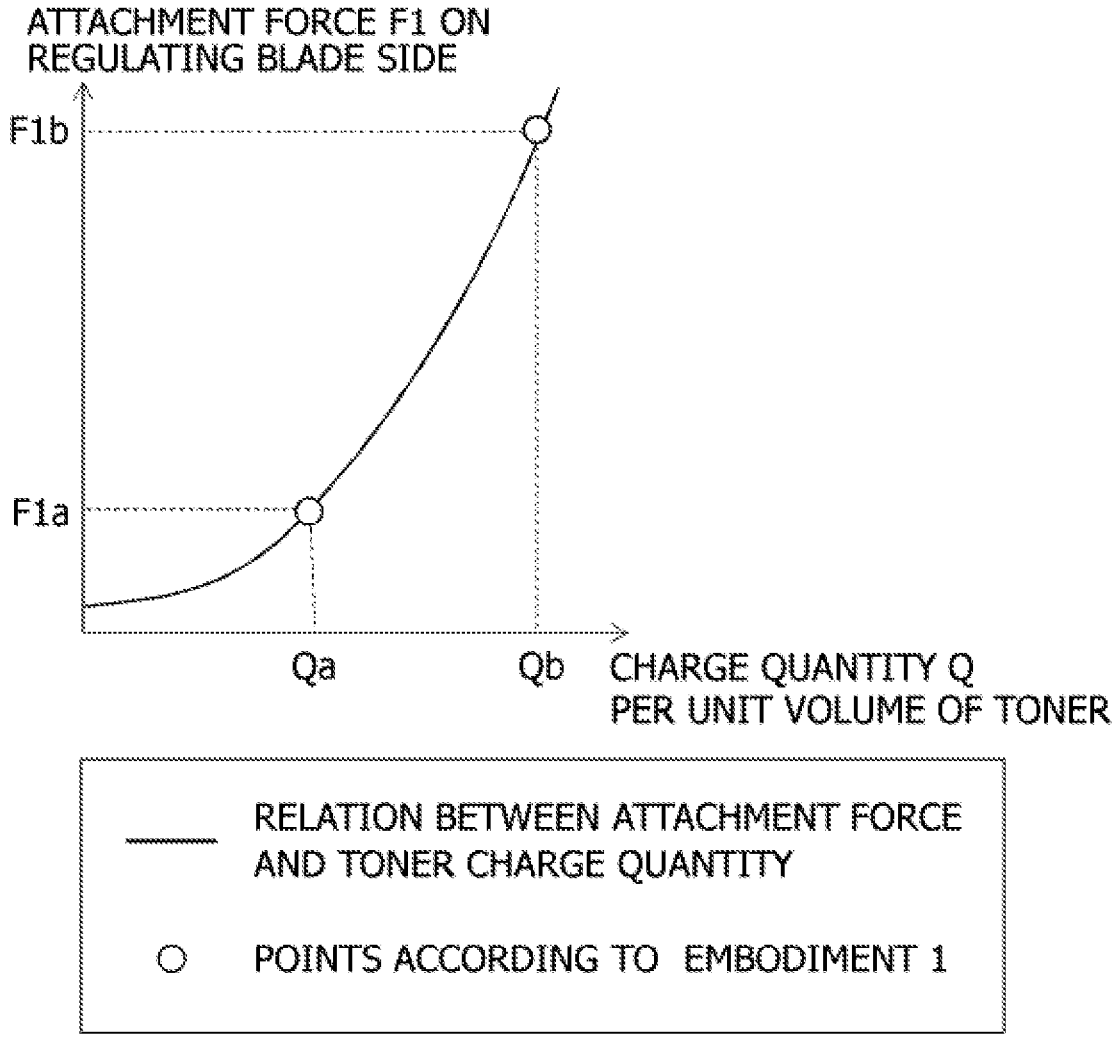
FIG. 6A is diagram illustrating a relation between attachment force F1 and a toner charge quantity.
Figure 6B:
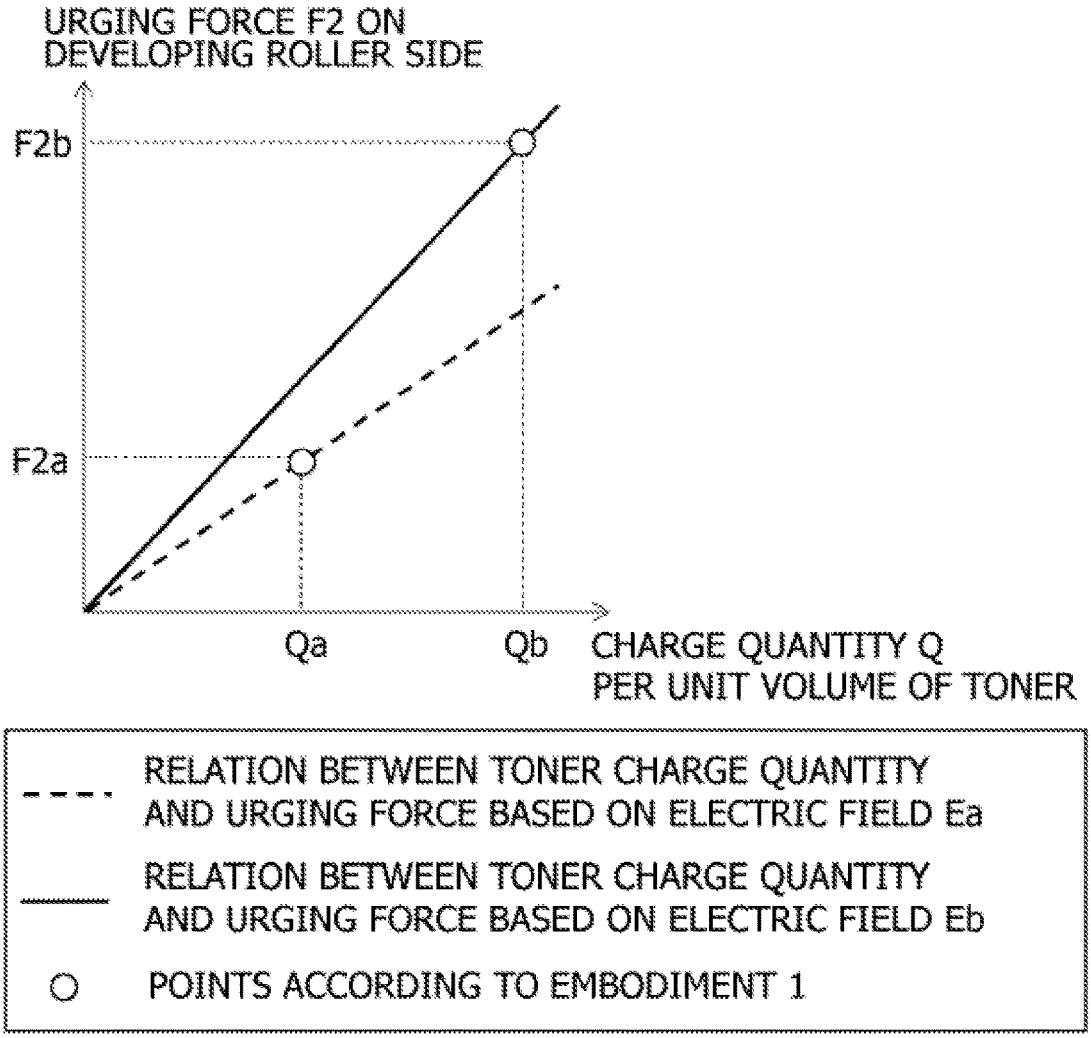
FIG. 6B is diagram illustrating a relation between urging force F2 and a toner charge quantity.

FIGS. 6A and 6B are diagrams illustrating a relation between the attachment force F1 and the urging force F2 and the toner charge quantities, in which FIG. 6A illustrates a relation between a toner charge quantity and the attachment force F1 toward the regulating blade 4 and FIG. 6B illustrates a relation between a toner charge quantity and the urging force F2 toward the developing roller 3. The attachment force F1 is approximately proportional to the square of a toner charge quantity. The urging force F2 is proportional to a toner charge quantity and an electric field applied to toner. Particularly, as illustrated in FIG. 4, since the charge quantity of toner T increases as the toner T approaches the downstream side of the contact nip D, the toner T receives a large attachment force F1 and is likely to be fused to the regulating blade 4. For example, as illustrated in FIG. 5, the toner T on the most downstream side of the contact nip D receives the largest attachment force F1t. In contrast, like an urging force F2t acting on the toner T on the most-downstream side of the contact nip D illustrated in FIG. 5, for example, the urging force F2 is a force pressing the toner T toward the developing roller 3 and acts in a direction of preventing the toner T from being fused to the regulating blade 4.

As illustrated in FIG. 5, immediately before the toner T enters into the contact nip D (that is, on the most-upstream side of the contact nip D), the toner T near the surface of the developing roller 3 receives an attachment force F1s toward the developing roller 3 and an urging force F2s toward the developing roller 3. Here, since the urging force F2 toward the developing roller 3 acts on the toner T if the electric field Ea on the upstream side is large, a larger amount of toner T is conveyed to the regulating blade 4 with rotation of the developing roller 3. The larger the amount of toner entering toward the contact nip D, the higher the regulating blade 4 is raised and the more regulation defects occur. In order to prevent regulation defects, since the urging force F2s needs to be decreased particularly, the electric field Ea on the upstream side needs to be decreased. By increasing the electric field Eb on the downstream side to be smaller than the decreased electric field Ea on the upstream side, fusing of the toner T to the regulating blade 4 can be prevented while preventing regulation defects.

Here, as illustrated in FIG. 6A, as the toner T approaches the downstream side of the contact nip D, the toner T near the surface of the regulating blade 4 receives a large attachment force F1 toward the regulating blade 4. In connection with this, as illustrated in FIG. 6B, since the electric field Ea on the upstream side is increased so that the urging force F2 toward the developing roller 3 acts on the toner T, fusing of the toner T to the regulating blade 4 can be prevented without any influence on the regulation on the upstream side.

Here, when the thickness Lb on the downstream side is smaller than the thickness La on the upstream side as in the present embodiment, the electric field Eb on the downstream side is larger than the electric field Ea on the upstream side. First, a case in which the resin layer 42 is an insulating member will be described. In this case, the electric field applied from the supporting member 41 to the toner layer with the resin layer 42 disposed therebetween is approximately inverse-proportional to the distance from the supporting member 41. Due to this, when the thickness Lb on the downstream side is smaller than the thickness La on the upstream side, the electric field Eb on the downstream side is larger than the electric field Ea on the upstream side.

Next, a case in which the resin layer 42 has a semiconductive property as in the present embodiment will be described.

Figure 7:
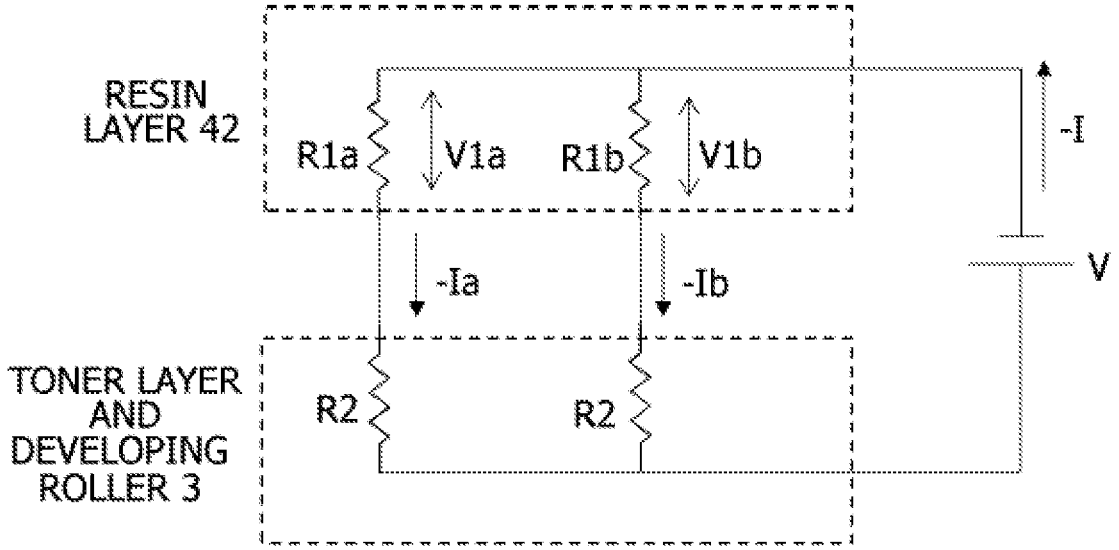
FIG. 7 is an electrical equivalent circuit diagram of a regulating blade and a developing roller.

FIG. 7 is an electrical equivalent circuit diagram of the regulating blade 4, the developing roller 3, and a blade bias application device. Here, an electrostatic capacitance component is ignored since a normal state in which a blade bias Δ is formed is considered. The resistance of the resin layer 42 includes a resistance R1a in the contact nip upstream Da and a resistance R1b in the contact nip downstream Db. Moreover, a combined resistance of the toner layer and the developing roller 3 is defined as a resistance R2. The resistance R2 is the same in the contact nip upstream Da and the contact nip downstream Db. A voltage V which is an absolute value of the blade bias Δ is applied to a circuit obtained by connecting a combined resistance R1a+R2 of the contact nip upstream Da and a combined resistance R1b+R2 of the contact nip downstream Db in parallel.

Here, a current flowing through the contact nip upstream Da is defined as a current Ia, a current flowing through the contact nip downstream Db is defined as a current Ib, and the sum of these currents is defined as a current I flowing through the entire regulating blade 4. A voltage drop in the contact nip upstream Da from the supporting member 41 to the contact nip D caused by the current flowing through the resin layer 42 is defined as a voltage drop V1a and a voltage drop in the contact nip downstream Db is defined as a voltage drop V1b. The voltage drop V1a on the upstream side and the voltage drop V1b on the downstream side are expressed by Equations 1 and 2 below.

$$V1a=I\cdot(R2\cdot R1a+R1a\cdot R1b)/(2R2+R1a+R1b) \quad \text{(Equation 1)}$$

$$V1b=I\cdot(R2-R1b+R1a\cdot R1b)/(2R2+R1a+R1b) \quad \text{(Equation 2)}$$

From Equations 1 and 2, it is understood that if the resistance R1b on the downstream side of the resin layer 42 is smaller than the resistance R1a on the upstream side of the resin layer 42, the voltage drop V1b on the downstream side is smaller than the voltage drop V1a on the upstream side. Here, the smaller the voltage drop V1a and the voltage drop V1b, the better the potential difference between the developing roller 3 and the surface of the regulating blade 4 is maintained. Due to this, in this case, the electric field Eb on the downstream side applied from the supporting member 41 to the toner layer with the resin layer 42 disposed therebetween is larger than the electric field Ea on the upstream side. Moreover, the resistance of the resin layer 42 is proportional to the thickness of the resin layer 42. Therefore, when the thickness Lb on the downstream side of the resin layer 42 is smaller than the thickness La on the upstream side of the resin layer 42, the resistance R1b on the downstream side is smaller than the resistance R1a on the upstream side. As a result, as described above, the electric field Eb in the contact nip downstream Db applied to the toner layer is larger than the electric field Ea in the contact nip upstream Da. Due to this, in a case in which the resin layer 42 has a semiconductive property as in the present embodiment, when the thickness Lb on the downstream side is smaller than the thickness La on the upstream side, the electric field Eb on the downstream side is larger than the electric field Ea on the upstream side. In this manner, by increasing the thickness La on the upstream side and decreasing the electric field Ea on the upstream side, it is possible to prevent regulation defects. Furthermore, by decreasing the thickness Lb on the downstream side to be smaller than the thickness La on the upstream side to increase the electric field Eb on the downstream side, it is possible to prevent the regulating blade fusion.

In the present embodiment, as described above, the regulating blade 4 is in counter-contact with respect to the rotation direction of the developing roller 3. In such a configuration, since a portion of the supporting member 41 at a position where the contact nip D is formed is distant from a supporting point that supports the supporting member 41, the supporting member 41 is likely to be deformed. As a result, a contact pressure for regulating toner is likely to vary and regulation defects are likely to occur. Moreover, when the blade bias Δ is decreased to suppress regulation defects, the regulating blade fusion may occur. However, by applying the configuration of the present embodiment to such a counter-contact configuration, it is possible to suppress regulation defects and the regulating blade fusion. Moreover, it is possible to set the blade bias Δ so as to prevent both regulation defects and the regulating blade fusion.

Evaluation Method

Here, an evaluation method for evaluating respective items, performed to confirm the advantages of the present embodiment will be described. In order to evaluate fogging, toner remaining on the photosensitive drum 1 after transfer at the time of printing a solid white image is transferred to a transparent tape and the tape having the toner attached thereto is attached to an evaluation recording paper. A tape having no toner attached thereto is also attached to the same recording paper. An optical reflectance is measured above the tape attached to the recording paper using a green filter and an optical reflectance meter (TC-6DS: product of Tokyo Denshoku) and is subtracted from a reflectance of the tape having no toner attached thereto to obtain a reflectance amount corresponding to fogging, which is evaluated as a fogging amount. By observing fogging on the photosensitive drum 1 after transfer at the time of printing a solid image, it is possible to evaluate fogging which has been developed in a non-printing portion and has not been transferred due to a low charge quantity. A white paper is used as an evaluation recording paper, and 10 or more sheets of the same paper is placed under the recording paper when measuring the density. The reflectance is measured at three or more points on the tape and an average value thereof is used as the fogging amount. Fogging is evaluated as "Bad" when the fogging amount is 3% or more, "Ordinary" when the amount is 1% or more, "Good" when the amount is 0.5% or more and less than 1%, and "Very Good" when the amount is less than 0.5%.

Regulation defects are evaluated by observing the occurrence of density unevenness on an output image at the timing of printing a halftone image. The regulation defects are evaluated as "Bad" when density unevenness occurred and "Good" when density unevenness did not occur. Regulating blade fusion is evaluated by observing the occurrence of vertical streaks on an output image at the time of printing a solid black image. The fusing is evaluated as "Bad" when the vertical streaks occurred and "Good" when the vertical streaks did not occur. These evaluations are verified by observing the states after 6000 pages of sheets are printed in Embodiment, Comparative Examples, and Modification.

Moreover, the blade bias Δ is evaluated at respective values of −100 V, −150 V, −200 V, and −250 V. When the blade bias Δ is not applied or a plus-side potential difference is formed, fixing or fusing of toner to the regulating blade 4 occurred. Due to this, in this example, a minus-side blade bias Δ is formed.

Comparative Example 1

Figure 9:
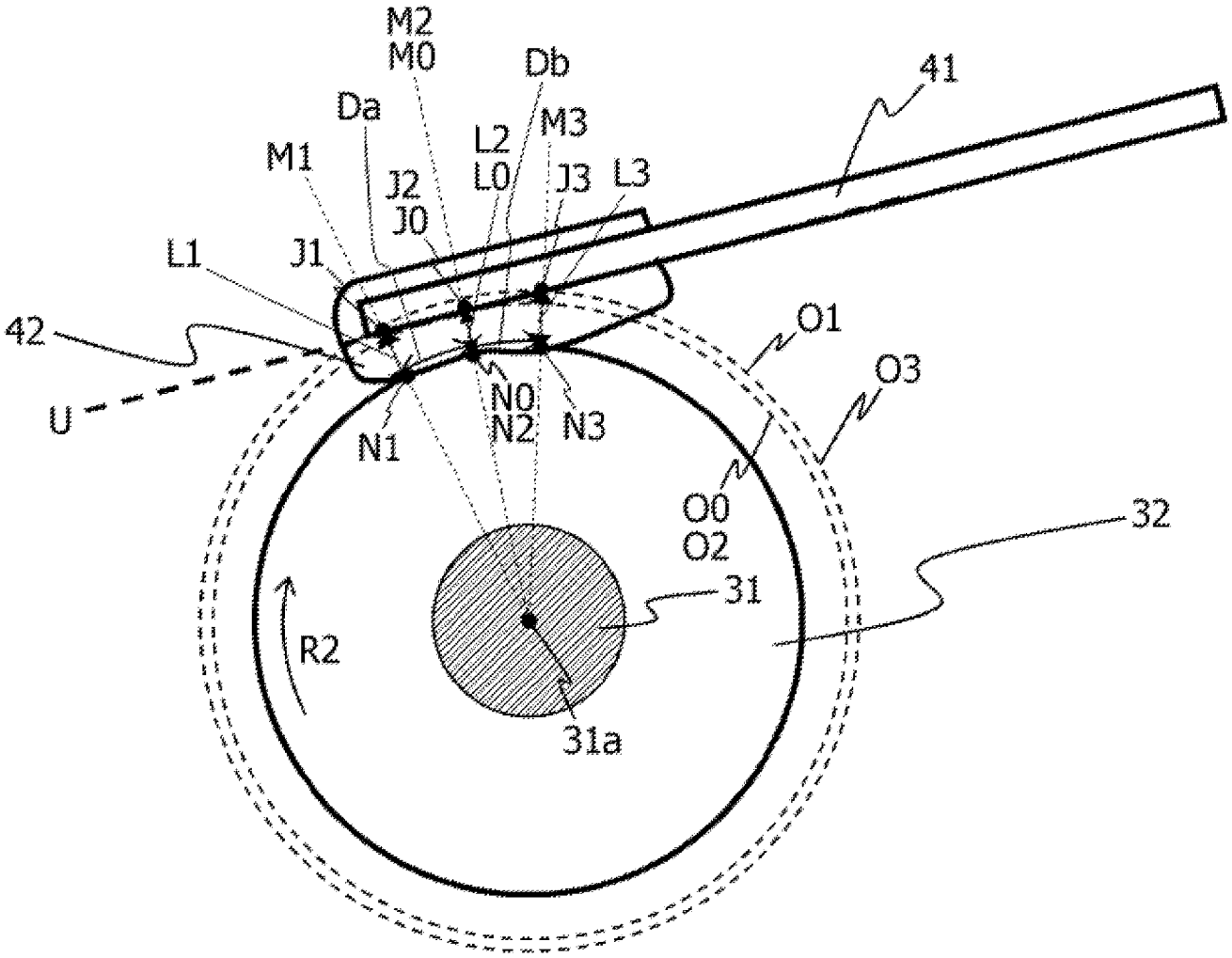
FIG. 9 is a schematic cross-sectional view of a developer carrying member and a regulating member according to Comparative Example 1.

The shape and the contact state of the regulating blade 4 according to Comparative Example 1 will be described with reference to FIG. 9. The configuration of Comparative Example 1 other than the regulating blade 4 is the same as that of Embodiment 1, and the description thereof will be omitted. FIG. 9 is a schematic cross-sectional view illustrating a state in which the regulating blade 4 of Comparative Example 1 makes contact with the developing roller 3. In Comparative Example 1, unlike Embodiment 1, the thickness La of the resin layer 42 in the upstream portion Da of the contact nip D is equal to the thickness Lb of the resin layer 42 in the downstream portion Db of the contact nip D.

Comparative Example 2

Figure 10:
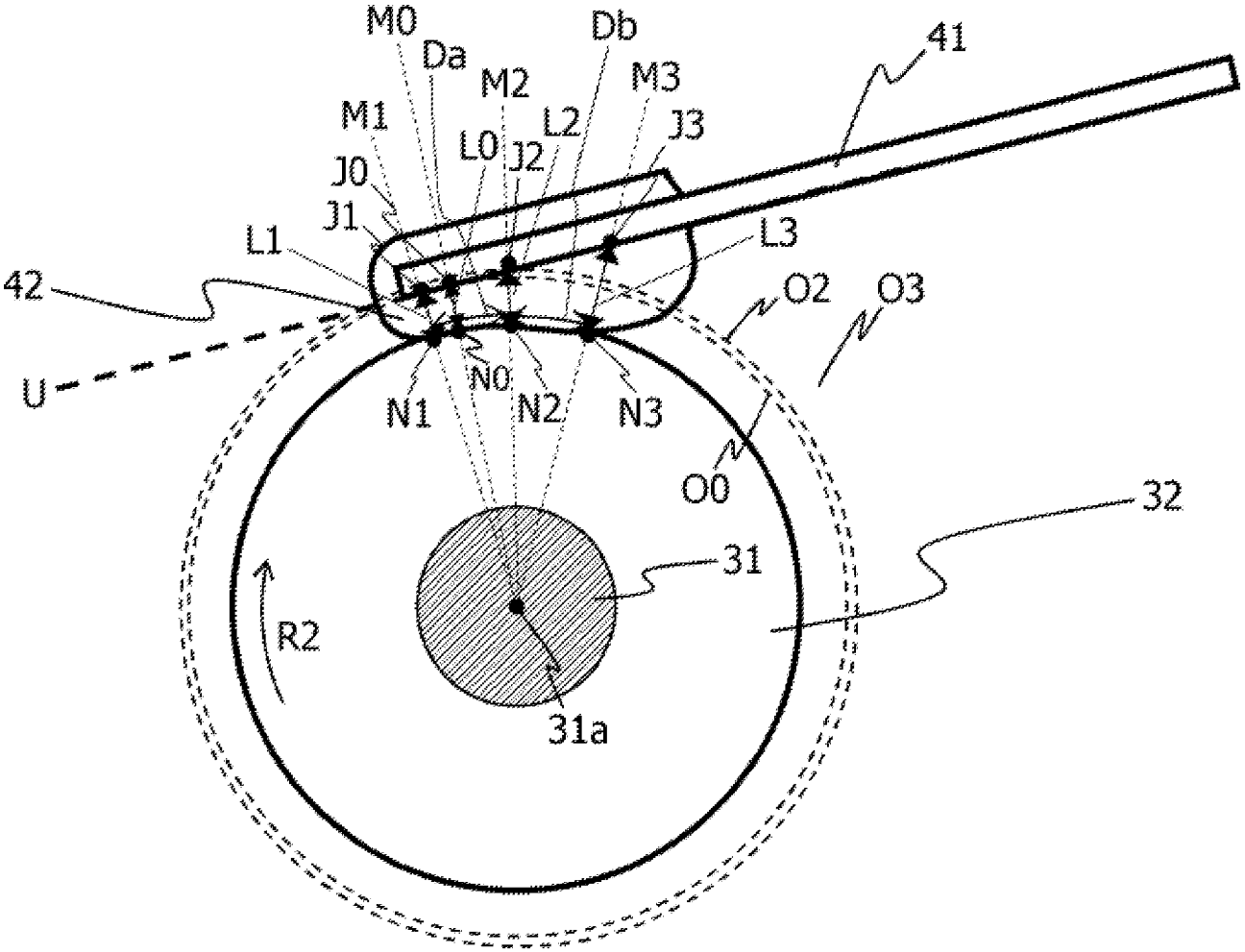
FIG. 10 is a schematic cross-sectional view of a developer carrying member and a regulating member according to Comparative Example 2.

The shape and the contact state of the regulating blade 4 according to Comparative Example 2 will be described with reference to FIG. 10. The configuration of Comparative Example 2 other than the regulating blade 4 is the same as that of Embodiment 1, and the description thereof will be omitted. FIG. 10 is a schematic cross-sectional view illustrating a state in which the regulating blade 4 of Comparative Example 2 makes contact with the developing roller 3. In Comparative Example 2, unlike Embodiment 1, the thickness Lb of the resin layer 42 in the downstream portion Db of the contact nip D is larger than the thickness La of the resin layer 42 in the upstream portion Da of the contact nip D.

Comparison Between Embodiment 1, Comparative Example 1, and Comparative Example 2

Evaluation results when an image is actually formed using the developing apparatuses of Embodiment 1, Comparative Example 1, and Comparative Example 2 are illustrated in Table 1.

TABLE 1

| Configuration | Relation between upstream-side thickness and downstream-side thickness of resin layer | Evaluation item | Blade bias Δ [V] −100 | −150 | −200 |
|---|---|---|---|---|---|
| Embodiment 1 | La > Lb | Fogging | Bad | Ordinary | Good |
| | | Regulation defects | Good | Good | Good |
| | | Regulating blade fusion | Bad | Good | Good |
| Comparative Example 1 | La = Lb | Fogging | Bad | Ordinary | Good |
| | | Regulation defects | Good | Good | Bad |
| | | Regulating blade fusion | Bad | Bad | Good |
| Comparative Example 2 | La < Lb | Fogging | Bad | Ordinary | Good |
| | | Regulation defects | Good | Bad | Bad |
| | | Regulating blade fusion | Bad | Bad | Bad |

As illustrated in Table 1, when the blade bias Δ is increased, fogging and regulating blade fusion are suppressed but regulation defects worsen. In Comparative Examples 1 and 2, it is not possible to suppress regulation defects and regulating blade fusion. In contrast, in Embodiment 1, since the electric field Ea applied to the toner in the contact nip upstream Da is weakened, the regulation defects are suppressed. Moreover, in Embodiment 1, since the electric field Eb applied to the toner in the contact nip downstream Db is strengthened, regulating blade fusion is suppressed. As a result, it is possible to prevent regulation defects and regulating blade fusion by controlling the blade bias Δ. Moreover, it is possible to decrease fogging by increasing the toner charge quantity.

As described above, with the configuration of the present embodiment, it is possible to prevent both regulation defects and regulating blade fusion while suppressing fogging.

Embodiment 2

Figure 8:
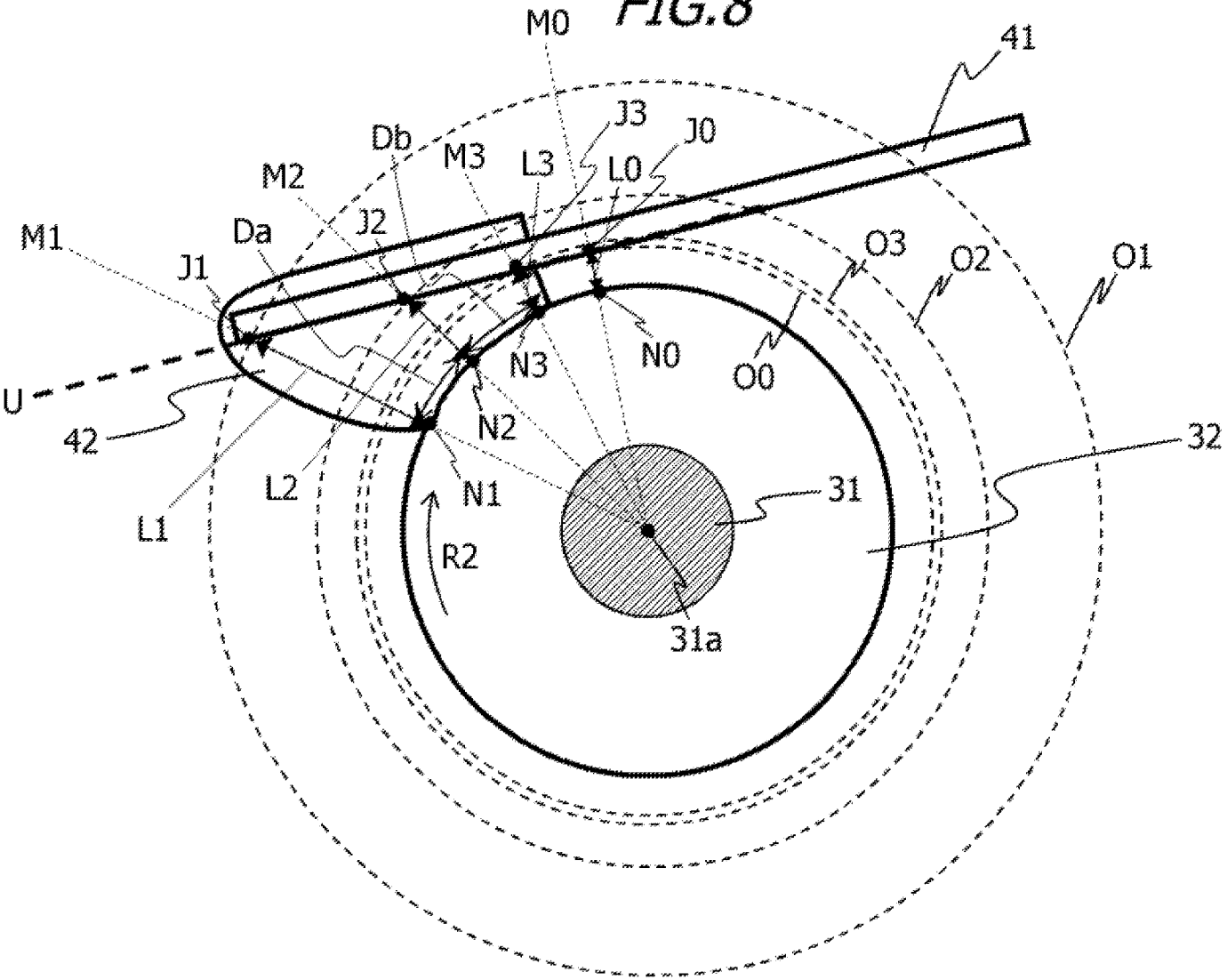
FIG. 8 is a schematic cross-sectional view of a developing roller and a regulating blade according to Embodiment 2.

A developing apparatus according to Embodiment 2 of the present invention will be described with reference to FIG. 8. The configuration of Embodiment 2 other than the regulating blade 4 is the same as that of Embodiment 1, and the description thereof will be omitted. FIG. 8 is a schematic cross-sectional view illustrating a state in which the regulating blade 4 of Embodiment 2 makes contact with the developing roller 3. In Embodiment 2, similarly to Embodiment 1, the relation between the thickness La of the resin layer 42 in the upstream portion Da of the contact nip D and the thickness Lb of the resin layer 42 in the downstream portion Db of the contact nip D is set such that the thickness Lb on the downstream side is smaller than the thickness La on the upstream side. Due to this, similarly to Embodiment 1, it is possible to prevent both regulation defects and regulating blade fusion while suppressing fogging.

However, in Embodiment 2, the width of the contact nip D is larger than that of Embodiment 1. Due to this, the charge quantity of the toner T on the downstream side of the contact nip D is further higher than that of Embodiment 1. By increasing the charge quantity of the toner T, fogging can be suppressed further. On the other hand, as for regulating blade fusion, the attachment force F1 toward the regulating blade 4 is increased on the downstream side of the contact nip D, and it is difficult to suppress regulating blade fusion by controlling the blade bias Δ. Particularly, when the blade bias Δ is small and the urging force F2 toward the developing roller 3 applied to the toner T is small, regulating blade fusion is likely to occur. In contrast, in Embodiment 2, the relation between a contact pressure Ka (a first contact pressure) in the contact nip upstream Da and a contact pressure Kb (a second contact pressure) in the contact nip downstream Db is set such that the contact pressure Kb on the downstream side is smaller than the contact pressure Ka on the upstream side. The relation between contact pressures is measured using a tactile (product of Nitta Corporation).

A method of setting the contact pressure Ka and the contact pressure Kb will be described. The contact pressure can be set by changing a virtual penetration amount of the resin layer 42 into the developing roller 3 in the contact nip upstream Da on the upstream side and the contact nip downstream Db on the downstream side. Here, the virtual penetration amount is an overlapping amount when the regulating blade 4 in a no-load state where the developing roller 3 is not assembled and the developing roller 3 in a no-load state where the regulating blade 4 is not assembled are virtually superimposed in a cross-section seen from the direction of the rotation axis of the developing roller 3.

Modification A

The configuration of Modification A other than the regulating blade 4 is the same as that of Embodiment 2, and the description thereof will be omitted. In Modification A, similarly to Embodiment 2, the width of the contact nip D is larger than that of Embodiment 1. Due to this, the toner charge quantity is increased further on the drive boss of the contact nip than Embodiment 1. Due to this, in Modification A, similarly to Embodiment 2, fogging can be suppressed further. On the other hand, as for regulating blade fusion, it is difficult to suppress regulating blade fusion by controlling the blade bias Δ. Moreover, in modification A, unlike Embodiment 2, a relation between the contact pressure Ka in the contact nip upstream Da and the contact pressure Kb in the contact nip downstream Db is set such that the contact pressure Kb on the downstream side is larger than the contact pressure Ka on the upstream side.

Comparison Between Embodiment 2 and Modification A

Evaluation results when an image is actually formed using the developing apparatuses of Embodiment 2 and Modification A are illustrated in Table 2.

TABLE 2

| Configuration | Relation between upstream-side contact pressure and downstream-side contact pressure | Evaluation item | Blade bias Δ [V] −100 | −150 | −200 | −250 |
|---|---|---|---|---|---|---|
| Embodiment 2 | Ka > Kb | Fogging | Ordinary | Good | Good | Very Good |
| | | Regulation defects | Good | Good | Good | Good |
| | | Regulating blade fusion | Bad | Good | Good | Good |
| Modification A | Ka < Kb | Fogging | Ordinary | Good | Good | Very Good |
| | | Regulation defects | Good | Good | Good | Bad |
| | | Regulating blade fusion | Bad | Bad | Good | Good |

As illustrated in Table 2, in Modification A, the range of blade biases Δ where both regulation defects and regulating blade fusion are suppressed is narrow. In this evaluation, it is possible to prevent both regulation defects and regulating blade fusion when the blade bias Δ is −200 V only. In contrast, in Embodiment 2, the range of blade biases Δ where both regulation defects and regulating blade fusion are suppressed is wider than that of Modification A.

First, a case in which the blade bias Δ is −150 V will be compared. In Embodiment 2, unlike Modification A, since the contact pressure Kb on the downstream side is smaller than the contact pressure Ka on the upstream side, it is possible to prevent regulating blade fusion while suppressing occurrence of regulation defects due to the small contact pressure Ka on the upstream side. The regulating blade fusion can be prevented due to the effect of reducing the chance of toner to make contact with the regulating blade 4 while suppressing stress on the toner in the contact nip downstream Db.

Next, a case in which the blade bias Δ is −250 V will be compared. In Embodiment 2, unlike Modification A, since the contact pressure Ka on the upstream side is larger than the contact pressure Kb on the downstream side, it is possible to prevent regulation defects while suppressing occurrence of regulating blade fusion due to the large contact pressure Kb on the downstream side. The regulation defects can be prevented since the contact pressure Ka in the contact nip upstream Da prevents the regulating blade 4 from being raised by the conveyed toner. Furthermore, in Embodiment 2, as compared to Modification A, since regulation defects can be prevented even when the blade bias Δ is increased, it is possible to suppress fogging further.

As described above, according to the present embodiment, by setting the contact pressure Kb on the downstream side to be smaller than the contact pressure Ka on the upstream side, it is possible to prevent both regulation defects and regulating blade fusion while suppressing fogging further.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-199261, filed on Oct. 13, 2017, which is hereby incorporated by reference herein in its entirety.

What is claimed is:

1. A developing apparatus comprising:

a developer carrying member that carries a developer;

a development frame member that rotatably supports the developer carrying member and stores the developer; and a regulating member provided in the development frame member to regulate a thickness of the developer carried on the developer carrying member, wherein the regulating member includes a supporting member having a conductive property, and a contact member having a larger resistivity than that of the supporting member, in a cross-section orthogonal to a rotation axis direction of the developer carrying member, the contact member has a contact portion that contacts with a surface of the developer carrying member, and the supporting member is disposed to be present on a normal line of the developer carrying member passing through the contact portion, and the contact portion has a first region and a second region positioned on a downstream side of the first region in a rotation direction of the developer carrying member, wherein when a thickness of the contact member, between the first region and the supporting member, in a first direction along a first normal line passing through the first region, is a first thickness, and a thickness of the contact member, between the second region and the supporting member, in a second direction along a second normal line passing through the second region, is a second thickness, the first thickness is larger than the second thickness, wherein when a third normal line of the developer carrying member, passing through a position at which a distance between a rotation center of the developer carrying member and the supporting member is the shortest, is used as a reference, the contact portion is disposed at a position which is not on the downstream side of the third normal line but on the upstream side of the developer carrying member, in the rotation direction of the developer carrying member, and wherein when a potential of the supporting member is V1 and a potential of the developer carrying member is V2 during a developing operation, a polarity of a potential difference (V1−V2) between the supporting member and the developer carrying member is the same as a charging polarity of the developer.

2. The developing apparatus according to claim 1, wherein a relation, between a first contact pressure at which the first region contacts with the developer carrying member and a second contact pressure at which the second region contacts with the developer carrying member, is set such that the second contact pressure is smaller than the first contact pressure.

3. The developing apparatus according to claim 1, wherein the regulating member contacts with the developer carrying member such that one end thereof is supported by the development frame member and the other end thereof, which is a free end, faces the upstream side in the rotation direction of the developer carrying member.

4. A developing apparatus comprising:

a developer carrying member that carries a developer;

a development frame member that rotatably supports the developer carrying member and stores the developer; and a regulating member provided in the development frame member to regulate a thickness of the developer carried on the developer carrying member, wherein the regulating member includes:

a first contact portion that contacts with the developer carrying member, a first conductive portion that has a smaller resistivity than that of the first contact portion, and that faces a surface of the developer carrying member at a first distance with the first contact portion disposed therebetween, a second contact portion that contacts with the developer carrying member on a downstream side of the first contact portion in a rotation direction of the developer carrying member, and a second conductive portion that has a smaller resistivity than that of the second contact portion, and facing the surface of the developer carrying member on the downstream side of the first conductive portion in the rotation direction of the developer carrying member, at a second distance shorter than the first distance with the second contact portion disposed therebetween, and wherein, potentials of the first and second conductive portions are configured to be larger than a potential of the developer carrying member and be the same polarity as a charging polarity of the developer, during a developing operation.

5. The developing apparatus according to claim 4, wherein a thickness of the first contact portion is larger than a thickness of the second contact portion in a direction orthogonal to a rotation axis of the developer carrying member.

6. The developing apparatus according to claim 4, wherein a contact pressure at which the first contact portion contacts with the developer carrying member, is larger than the one at which the second contact portion contacts with the developer carrying member.

7. The developing apparatus according to claim 4, wherein the regulating member includes:

a supporting member having a conductive property and including the first conductive portion and the second conductive portion; and a contact member having a larger resistivity than that of the supporting member and including the first contact portion and the second contact portion.

8. The developing apparatus according to claim 7, wherein the supporting member has a cantilever structure in which one end side thereof is supported by the development frame member, and the other end side thereof including a free end positioned on an upstream side in the rotation direction of the developer carrying member, the other one end side contacts with the developer carrying member with the contact member disposed therebetween.

9. The developing apparatus according to claim 7, wherein the supporting member has a region, that faces the surface of the developer carrying member at a distance shorter than the second distance, on the downstream side of a region contacts with the developer carrying member with the contact member disposed therebetween, in the rotation direction of the developer carrying member.

10. The developing apparatus according to claim 1, wherein the regulating member is applied with a bias having a magnitude on the same polarity side as the charging polarity of the developer with respect to a bias applied to the developer carrying member during a developing operation.

11. The developing apparatus according to claim 1, wherein the developer stored in the development frame member is a non-magnetic one-component developer.

12. A developing apparatus comprising:

a developer carrying member that carries a developer;

a development frame member that rotatably supports the developer carrying member and stores the developer; and a regulating member provided in the development frame member to regulate a thickness of the developer carried on the developer carrying member, wherein the regulating member includes a supporting member having a conductive property, and a contact member having a larger resistivity than that of the supporting member, in a cross-section orthogonal to a rotation axis direction of the developer carrying member, the contact member has a contact portion that contacts with a surface of the developer carrying member, and the supporting member is disposed to be present on a normal line of the developer carrying member passing through the contact portion, and the contact portion has a first region and a second region positioned on a downstream side of the first region in a rotation direction of the developer carrying member, wherein when a thickness of the contact member, between the first region and the supporting member, in a first direction along a first normal line passing through the first region, is a first thickness, and a thickness of the contact member, between the second region and the supporting member, in a second direction along a second normal line passing through the second region, is a second thickness, the first thickness is larger than the second thickness, wherein when a third normal line of the developer carrying member, passing through a position at which a distance between a rotation center of the developer carrying member and the supporting member is the shortest, is used as a reference, the contact portion is disposed at a position where is not on the downstream side of the third normal line but on the upstream side of the developer carrying member, in the rotation direction of the developer carrying member, and wherein, a potential difference having the same polarity as a charging polarity of the developer toward the supporting member, is formed between the supporting member and the developer carrying member, during a developing operation.

13. A process cartridge detachably attached to an apparatus body of an image forming apparatus, the process cartridge comprising:

an image bearing member on which an electrostatic latent image is formed; and the developing apparatus according to claim 1, for developing the electrostatic latent image.

14. An image forming apparatus comprising:

the developing apparatus according to claim 1;

an apparatus body to which the developing apparatus is detachably attached; and a bias application portion that applies biases having different magnitudes to the developer carrying member and the regulating member.

* * * * *